United States Patent [19]

Moscardini

[11] Patent Number: 4,641,789

[45] Date of Patent: Feb. 10, 1987

[54] COMPACTOR ENHANCEMENT SYSTEM

[75] Inventor: Robert L. Moscardini, Simsbury, Conn.

[73] Assignee: Combustion Engineering, Inc., Windsor, Conn.

[21] Appl. No.: 565,601

[22] Filed: Dec. 27, 1983

[51] Int. Cl.[4] ..... B02L 23/02; B02L 23/04

[52] U.S. Cl. ..... 241/31; 241/36; 241/58; 241/159; 241/186 R; 241/236; 241/285 B; 241/DIG. 14

[58] Field of Search ..... 241/31, 33, 36, 58, 241/152 R, 152 A, 157, 158, 159, 186 R, 236, 243, 285 A, 285 B, DIG. 14

[56] References Cited

U.S. PATENT DOCUMENTS

| | | | |
|---|---|---|---|
| 960,027 | 5/1910 | Low | 241/101.2 X |
| 3,727,850 | 4/1973 | Krigbaum | 241/159 |
| 3,913,849 | 10/1975 | Atanasoff et al. | 241/99 X |
| 4,034,918 | 7/1977 | Culbertson et al. | 241/36 |
| 4,134,552 | 1/1979 | Fraser et al. | 241/33 |
| 4,269,364 | 5/1981 | Moriconi et al. | 241/285 A |
| 4,356,981 | 11/1982 | Meadows | 241/31 X |

*Primary Examiner*—Mark Rosenbaum
*Assistant Examiner*—Timothy V. Eley
*Attorney, Agent, or Firm*—Prutzman, Kalb, Chilton & Alix

[57] ABSTRACT

An automatic compactor enhancement reduces the volume of compactable low-level radioactive wastes and transfers the reduced wastes to a nearby waste compactor. The wastes are shredded by a primary shredder assembly and a secondary shredder assembly. The system employs a pressure-controlled enclosure means to house the shredder assemblies and to control the release of wastes to the environment. A number of safety features are integrated into the system to enhance the operational safety of the system.

16 Claims, 4 Drawing Figures

COMPACTOR ENHANCEMENT SYSTEM

BACKGROUND OF THE INVENTION

This invention relates to a shredding system for use in association with a compactor to enhance storage capacity for waste materials. More particularly, this invention relates to a new and improved technique for use in the preparation of dry low-level radioactive wastes for compaction and subsequent storage.

One of the most well-known and most potentially serious challenges associated with the use and processing of nuclear materials is that of waste disposal and waste storage. Because of environmental considerations and numerous governmental regulations, on site storage of radioactive waste has become commonplace. Compactors are commonly employed to compact low radioactivity level waste materials to a dense compact form such that the available waste storage capacity may be resourcefully exploited. Shipping and burial constraints have also significantly increased the desirability of compacting low-level radioactive waste to reduce the waste volumes required for disposal.

The present invention is adapted for use in association with in place compactor systems to further reduce the void volume of the waste material to be disposed of or stored. Because the waste materials to be processed by the compactor enhancement system of the present invention will typically be radioactive, it is critical that means be employed to safely control the release of waste contaminants to the environment as well as to minimize environmental risks due to mechanical or systems malfunctions. An additional design constraint of the compactor enhancement system is the provision of automation means to minimize human exposure to the radioactive wastes.

BRIEF SUMMARY OF THE INVENTION

Briefly stated, the invention in a preferred form is an automatic shredding system for reducing the volume of compactable low-level radioactive wastes and transferring the reduced wastes to a nearby waste compactor means. The system employs a pressure-controlled enclosure to house the reduction and transferring means and to control the release of wastes to the environment. An advancing means, preferably in the form of a ram feeder, receives the waste and advances the waste into the enclosure. A reduction means in the form of a primary shredder assembly and a secondary shredder assembly is mounted within the enclosure to shred the advanced wastes to produce processed wastes having a reduced void volume. A transfer means transfers the processed wastes to a compactor. A pressure control means is provided to maintain the pressure within the enclosure at a level below the pressure of the ambient environment. Each of the shredder assemblies preferably includes a plurality of counter-rotatable shafts mounting a plurality of cutters. A combustion suppression means is provided to suppress combustion within the enclosure. Fail-safe means are provided to interrupt the operation of the system if the pressure within the enclosure exceeds a predetermined threshold pressure. An automatic clearing means is provided for clearing jammed waste from the shredder assembly. A system shut-down means is provided to interrupt operation of the system in the event of a failure to automatically clear a jamming condition.

In accordance with a method of the invention herein, the compactable low-level radioactive wastes to be treated are advanced to a shredding assembly. The shredding assembly shreds the wastes to produce processed waste having a reduced void volume. The processed wastes are transferred to a compactor means. Release of waste contaminants to the environment is controlled by means of maintaining the pressure in the enclosure which houses the shredding assembly at a level below the pressure of the ambient environment. The operational pressure within the enclosure is monitored to assure that the processing is accomplished in an environmentally safe manner. The operation of the waste reduction means and transferring means are monitored to ensure the operational safety of the system.

An object of the invention is to provide a new and improved compactor enhancement technique and system for processing dry low-level radioactive wastes for facilitating the storage and disposal of the wastes.

Another object of the invention is to provide a new and improved compactor enhancement technique and system which effectively reduces the void volume of low-level radioactive wastes for ready transferral of the wastes to a nearby compactor.

A further object of the invention is to provide a new and improved compactor enhancement system providing means for reducing the volume of radioactive waste materials while controlling the release of the waste materials to the environment.

A yet further object of the invention is to provide a new and improved compactor enhancement system having safety means for interrupting the operation of the system in the event of a system malfunction.

Other objects and advantages of the invention will become apparent from the drawings and specification.

BRIEF DESCRIPTION OF THE DRAWNG

DETAILED DESCRIPTION

Figure 1:
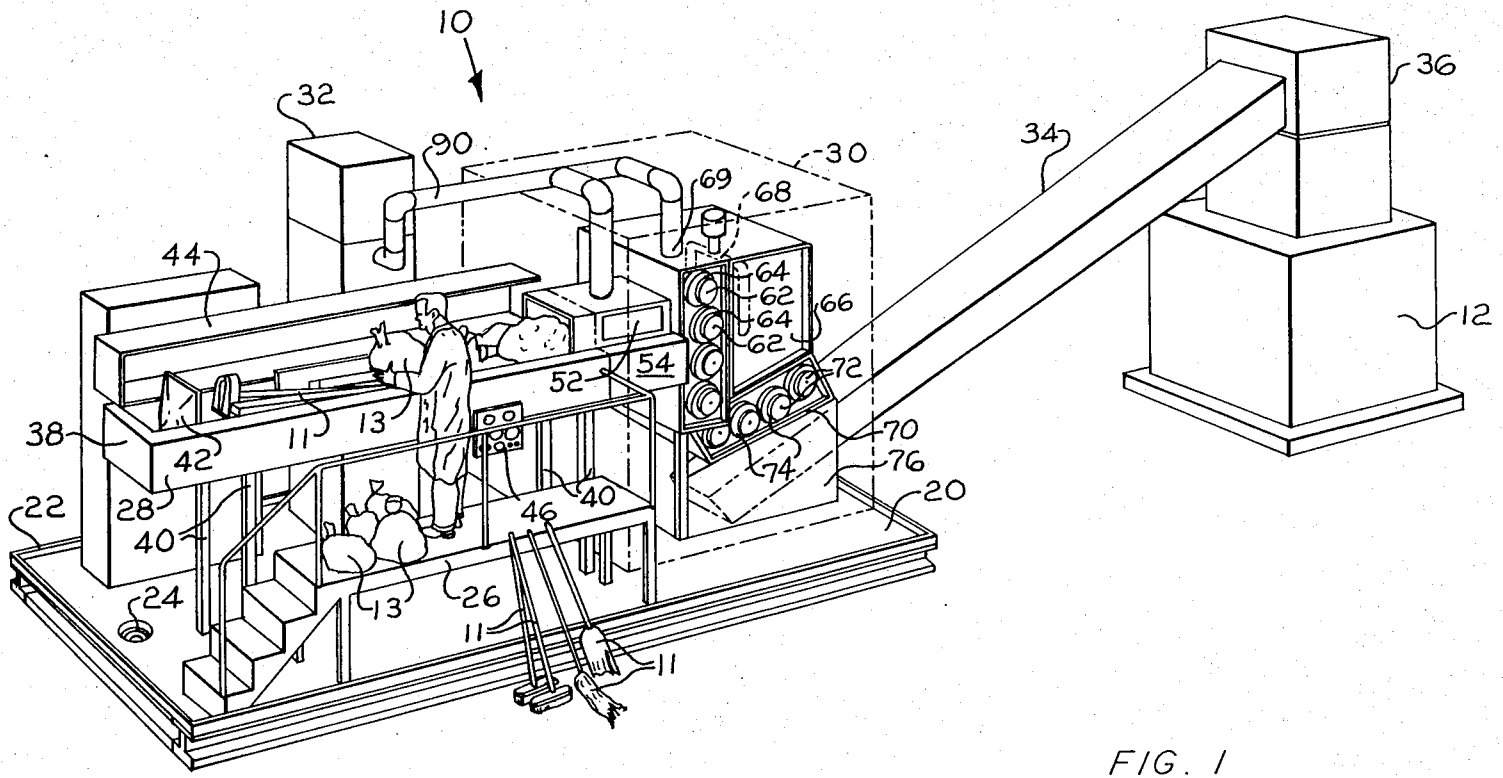
FIG. 1 is a perspective view of a compactor enhancement system in accordance with the present invention, an operator thereof being illustrated in the process of loading wastes into the system, parts of the housing of the system being broken away and shown in phantom.

With reference to the drawing, wherein like numerals represent like parts throughout the several figures, the compactor enhancement system of the present invention is generally designated by the numeral 10. With reference to FIG. 1, compactor enhancement system 10 is especially adapted for processing dry, low-level radioactive wastes prior to compacting the wastes by a compactor 12 (illustrated only generally) of conventional form. The compactor enhancement system 10 functions to reduce the volume of the waste prior to compaction by compactor 12 so that the low-level radiation waste storage capacity may be enhanced, and/or to facilitate disposal and shipping of the radioactive wastes. Because the compactor enhancement system of the present invention is particularly well-suited to the processing of low-level radioactive wastes, compactor enhancement system 10 includes a number of integrated features for controlling the release of wastes to the environment, enhancing the operational safety of the system, and interrupting the operation of the system in the event of the failure of one or more subsystems.

Dry, low-level radioactive wastes to be processed by compactor enhancement system 10 frequently assume the form of waste material or contaminants on brooms, mops, maintenance tools and utensils, clothing, and other conventional maintenance and cleaning items (designated generally in FIG. 1 by the numeral 11). The nonbulky items which form sites for low-level radiation contaminants are frequently prestored in plastic bags or other suitable storage receptacles (designated generally in FIG. 1 by the numeral 13). Disposal of the radioactive wastes includes disposal of the foregoing described articles which form sites for the wastes. These wastes are typically compacted in 55 gallon drums or 128 cubic feet boxes. Conventionally, an on-site compactor 12 is employed to compact the waste to a compacted form to reduce the waste volume and hence reduce the quantity of waste shipped off site for burial.

Compactor enhancement system 10 is supported on a skid-mounted base platform 20 which is preferably positioned in close proximity to compactor 12. An upstanding peripheral lip 22 cooperates with platform 20 to form a drip pan. A drain port 24 opens downwardly through platform to facilitate draining of the drip pan. Platform 20 supports an elevated loading platform 26, an elevated waste-loading assembly 28, a processor housing 30, and an environmental control housing 32. A conveyor housing 34 extends from processor housing 30 to an independently mounted compactor housing 36 for compactor 12.

Waste loading assembly 28 includes a laterally disposed elongated trough 38. Trough 38 is supported in a generally elevated position by means of support members 40. Trough 38 mounts a pneumatically driven ram feeder 42 having a receiving means (not shown) for receiving wastes as illustrated in FIG. 1. Ram feeder 42 may include a sprocket and roller chain ram drive directly coupled to a pneumatic motor. A hood 44 is hinged to trough 38 to form a retractable cover. A pneumatically operated cylinder opens and closes the hood automatically. Rubber gasket seals allow the trough 38 to be hermetically sealed when hood 44 is in the closed position. In the open position of FIG. 1, hood 44 is retracted so that an operator standing on the loading platform 26 may load the waste to be processed onto ram feeder 42. In a closed position, hood 44 encloses the received waste and ram feeder 42 to provide a substantial airtight seal. A safety means in the form of pressure switches and relays are provided to allow actuation of the system 10 only if hood 44 is positioned in the closed position. A control panel 46 having various controls and gauges may also be mounted to the exterior of trough 38 to facilitate access by the operator.

Figure 2:
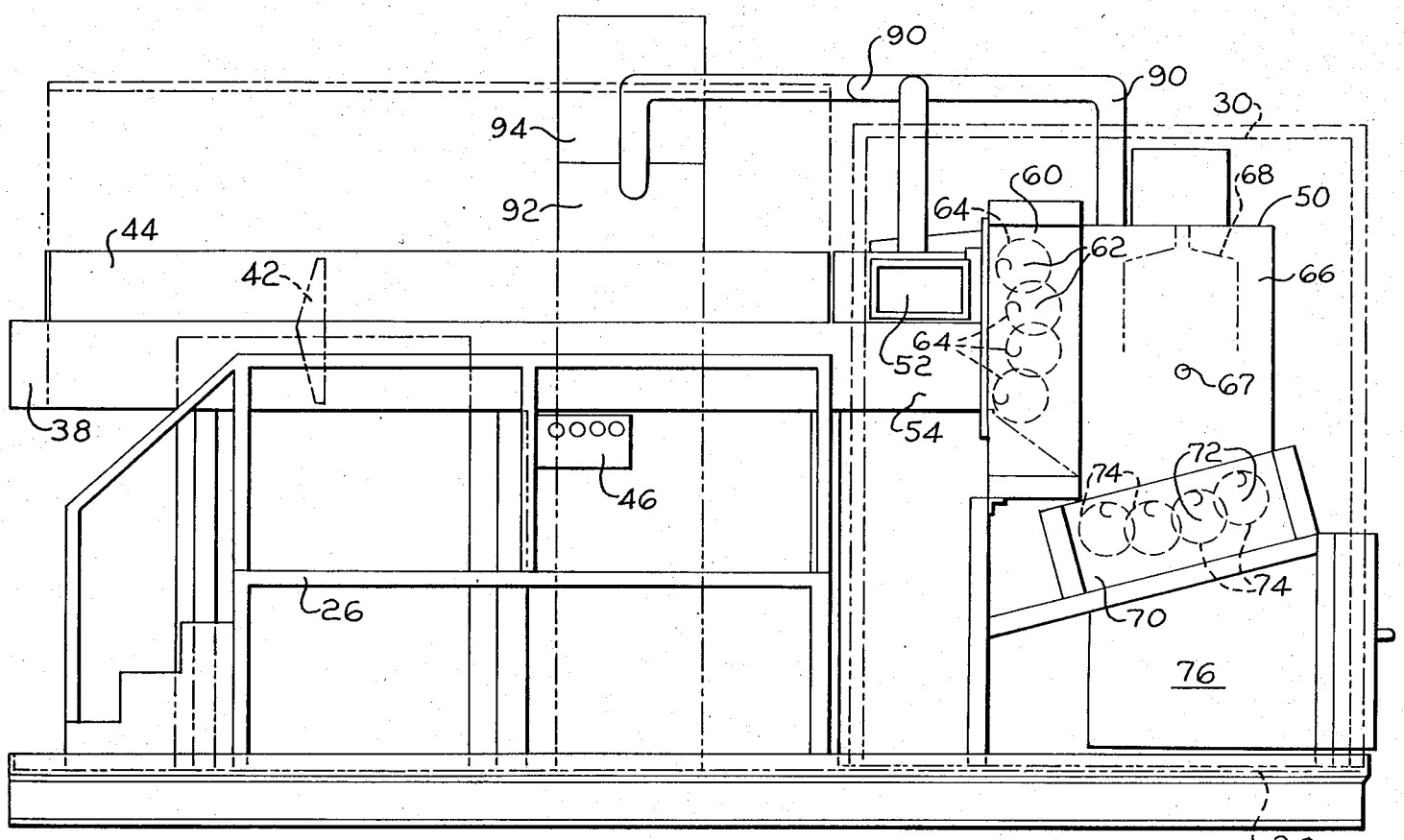
FIG. 2 is side elevation view of the compactor enhancement system of FIG. 1, portions thereof being shown schematically and in phantom.
Figure 3:
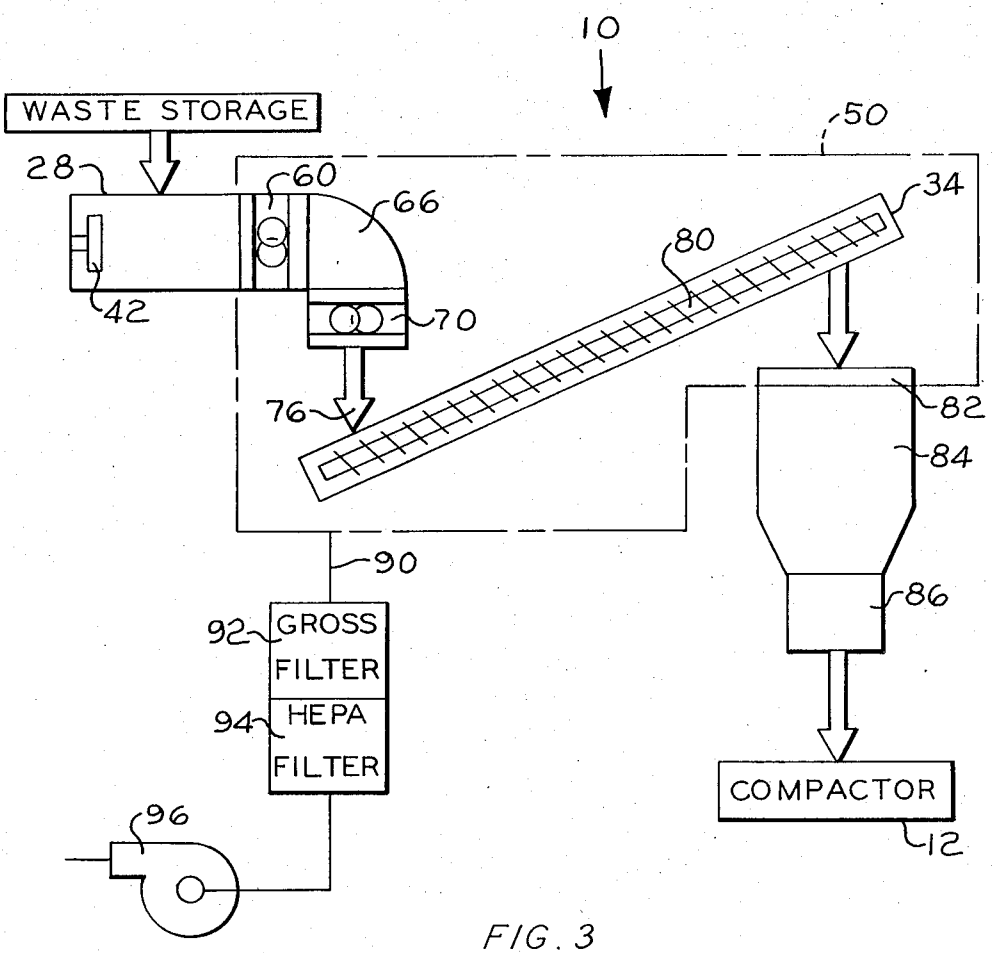
FIG. 3 is a schematic representation which depicts the operation of the compactor enhancement system of FIGS. 1 and 2.

A sturdy enclosure 50 of substantially box-like form, see FIGS. 2 and 3, is positioned interior of processor housing 30. Enclosure 50 is preferably constructed of heavy-gauge sheet carbon steel. The steel is welded to assure an air tight and dust proof integrity of enclosure 50. Enclosure 50 is adapted to provide an interior region having an operational pressure less than that of the ambient environment as will be more fully described below. Enclosure 50 has one or more doors 52 (only one being illustrated) to provide access to the interior of the enclosure for cleaning and maintenance purposes. Enclosure 50 further forms a forward receiving chute 54 which is in alignment with hood 44 and trough 38 for receiving wastes advanced by ram feeder 42.

Referring simultaneously to FIGS. 1–3, a primary shredder assembly 60 is mounted interiorly of enclosure 50. Primary shredder assembly 60 is interposed in the transport path of the waste material which exists from ram feeder 42 and is partially defined by chute 54. Primary shredder assembly 60 includes four counter-rotating shafts 62 mounting a plurality of cutters 64 (illustrated schematically). In a preferred embodiment, thirty-six (36) primary cutters and thirty-six (36) secondary cutters, each of a one and one-half inch wide high-shear, hook-type, alloy steel configuration are employed. The primary cutters may be supplied with removable inserts. The shafts 62 are belt driven by two 30 horsepower, dual-voltage, three-phase, 1800 rpm electric motors. The belts may also be coupled with speed reducers and a spur gearing.

The safety of the compactor enhancement system is enhanced by the automatic relieving of the ram pressure in the ram feeder in the event of a jamming condition. A safety control system in the form of a current sensing relay and zero speed switch in the primary shredder assembly 60 interlocks with a four-way solenoid valve on the ram feeder 42 to reduce the potential for jamming of the wastes in the shredder assembly and to consequently protect the motors.

The waste material exiting from primary shredder assembly 60 is collected in transition chute 66. Transition chute 66 has a high-level indicator 67 to sense the level of material in the chute and to activate means to interrupt the operation of the enhancement system in the event of excessive material buildup. Indicator 67 includes a mechanical level switch and functions to interrupt the enhancement system by stopping the primary shredder. A one horsepower agitator-type bridge breaker 68 positioned inside the transition chute facilitates the flow of shredded waste materials via chute 66 to a secondary shredder assembly 70. An air vent 69 is located in transition chute 66 to provide communication with an air and dust control system as will be described below.

The waste material exiting transition chute 66 passes through the secondary shredder assembly 70. Secondary shredder assembly 70 is also mounted within enclosure 50 to receive the wastes shredded by primary shredder assembly 60 and to further shred the waste to produce wastes having a smaller average fragment size than the waste fragments exiting the primary shredder assembly. Secondary shredder assembly 70 includes four counter-rotating shafts 72 which mount a plurality of cutters 74 (illustrated schematically). In a preferred embodiment, secondary shredder assembly 70 employs seventy-two (72) primary and seventy-two (72) secondary cutters of a three-fourths inch wide, high-shear type alloy steel configuration having removable inserts. Shafts 72 are belt-driven by two 30 horsepower dual-voltage, three-phase, 1800 rpm electric motors. A second safety control system in the form of a zero-speed switch and a current sensing relay to reduce the potential for jamming of the shredded waste materials is also incorporated into the secondary shredder assembly 70. The shredded waste materials exiting from secondary shredder assembly 70 enter a transition chamber 76.

The above-described shredder assemblies are adapted to process dry waste, including light metals such as aluminum and light gauge steel. The shredder assemblies may not be effective for processing hardened metals such as tool steels. It will be appreciated that the degree of reduction in the void volume of the processed waste materials will be dependent upon a number of factors, including the physical characteristics of the material being processed and the size and configuration of the cutters.

The processed waste materials received in transition chamber 76 are directed to a waste conveyor 80 which transfers the processed waste to nearby compactor 12. In a preferred form of the invention, waste conveyor 80 is a twin screw conveyor driven by a two horsepower electric motor. Waste conveyor 80 is enclosed by a conveyor housing 34. The conveyor housing 34 is constructed of heavy-gauge sheet carbon steel which is welded to assure an airtight and dust proof enclosure. Housing 34 communicates with enclosure 50 to form an enclosure system which functions to prevent the release of wastes to the environment. The processed wastes exit waste conveyor 80 and the enclosure system through an airlock 82 to a storage hopper 84. A bin discharger 86 employing a mechanical arch breaker provides a means for discharging the processed wastes from hopper 84 into compactor 12. Compactor 12 is typically of a form adapted for compacting wastes for storage in 55 gallon drums or 128 cubic feet boxes.

An environmental control system to control the release of wastes to the environment includes conduits 90 leading from enclosure 50 to control housing 32 which houses a filtering assembly. Conduits 90 lead to a gross filter 92 which is preferably a self-contained permanent cloth-type filter. A HEPA filter 94 is positioned at the exit of filter 92. A blower 96 is mounted on the clean air side, i.e., the exit, of the serially connected filters. Blower 96 preferably includes a centrifugal fan directly connected to the motor shaft of a one horsepower 3,450 rpm., dual-voltage, three-phase, continuous duty electric motor. Blower 96 is operated so that the operational pressure within the enclosure system is maintained at a pressure level less than minus two inches of water which is below that of the ambient environment. The latter described environmental control system in a preferred application moves approximately 400 cubic feet of air a minute at 4.5 inches of external static pressure and has a collection efficiency rating in excess of 99.97 percent by weight of all particles 0.3 microns and greater. Release of wastes to the environment is effectively controlled by the maintenance of an operational pressure within the enclosure system which is less than that of the ambient environment and by the filtering of air borne waste particles. The environmental control system is further provided with a means such as an automatic system shut down. If the pressure within enclosure 50 exceeds a predetermined threshold pressure value, such as such as minus two inches of water, then the operation of the compactor enhancement system is interrupted. This latter safety feature is accomplished by means of a preset pressure switch.

As previously described, operational safety features of the compactor enhancement system are provided by a safety control system in the primary shredder assembly 60 and a second safety control system in the secondary shredder assembly 70. Each of the safety control systems function so that upon sensing a jamming condition in a shredder assembly, the assemblies automatically stop and reverse to clear jammed material. The shredder assemblies then automatically restart. In a preferred embodiment, after three successing attempts to automatically clear the jammed material, the operation of the compactor enhancement system is interrupted. Restarting of the system can only be accomplished by the manual removal of the material which is jamming the assembly. Access to the jammed material is provided by door 52. The ram feeder 42, primary shredder assembly 60, and secondary shredder assembly 70 are interlocked in a coordinated fashion to accomplish the automatic relieving of a jamming condition. The interlocking feature is accomplished by means of contact switches and current sensing relays.

An additional safety feature of the compactor enhancement system is the provision of a combustion suppression system within the enclosures. A plurality of automatic dry chemical heads are located within the enclosure 50. Heat sensing detectors within the enclosure activate the dry chemical heads to suppress any combustion that may occur.

In summary, it should be appreciated from the foregoing description that compactor enhancement system 10 provides an efficient and safe means for reducing the void volume of dry low-level radioactive waste materials. The wastes are placed in waste-loading assembly 28 and advanced to the shredder assemblies by ram feeder 42. Primary shredder assembly 60 and secondary shredder assembly 70 cooperate to shred the waste materials to materials having successively reduced average fragment sizes. The reduced wastes are then transferred to a compactor 12 for ultimately compacting the wastes to a compacted storage configuration. The release of waste contaminants is controlled by numerous integrated safety control means as previously described and also by means of maintaining the pressure level in the enclosure system below the pressure of the ambient environment and by filtering air-borne waste materials from the enclosure. The operating pressure within the enclosure is monitored by means of pressure switches. The monitored pressure is then compared to a predetermined threshold pressure and the processing of waste materials is interupted if the operational pressure exceeds the predetermined threshold.

Figure 4:
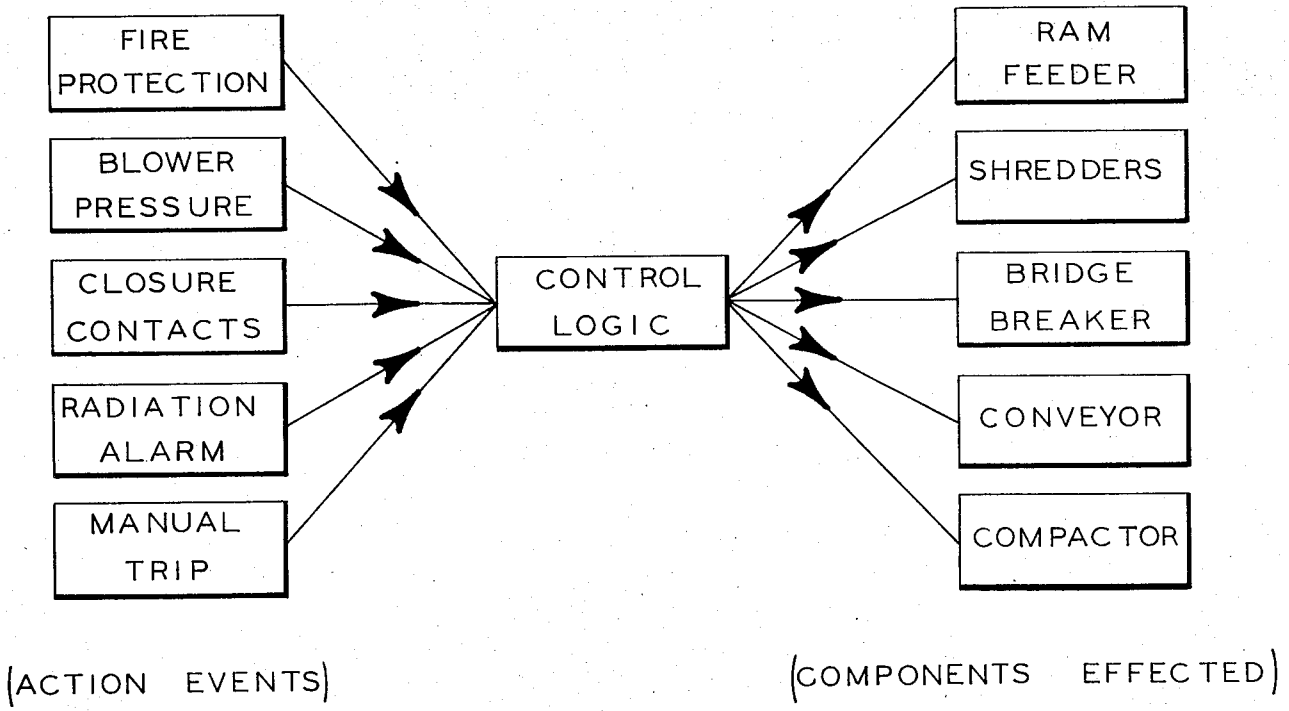
FIG. 4 is a logic diagram for the operation of the compactor enhancement system of FIG. 1.

A logic diagram for the safety operational control systems incorporated into a preferred embodiment of the compactor enhancement system of the present invention is illustrated in FIG. 4.

An example of a compactor enhancement system 10 constructed to have the capacity of receiving low-level dry radioactive waste batches up to a volume of approximately 40 cubic feet employs a ram feeder 42 having approximately 10 linear feet of usable receiving space. The waste materials in a form as previously described are received in throat openings of the primary and secondary shredder assemblies which are each dimensioned to be approximately 27 inches by 27 inches. Waste conveyor 80 is approximately 10 feet in effective length. Such a compactor enhancement system will reduce the compacted void volume of typical dry low-level radioactive wastes by as much as 30 percent as compared to the compacted volume resulting from compacting equal quantities of unprocessed wastes by conventional means.

While a preferred embodiment of the foregoing compactor enhancement system has been set forth for purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. Apparatus for treating contaminated articles, at least some of the articles to be treated having a low-level of radioactivity, said apparatus preparing the contaminated articles for compaction and comprising:

an inner housing;

shredder means disposed within said inner housing for reducing contaminated articles fed into said inner housing into fragments;

feeder means for delivering articles into said inner housing for fragmentation by said shredder means, said feeder means defining a first extension of said inner housing, said feeder means including:

an article receiving;

cover means for said trough, said cover means opening said trough to the ambient atmosphere when in an open loading condition and hermetically sealing said trough from the ambient atmosphere when in the closed feeding condition; and ram means, said ram means cooperating with said trough to force feed articles disposed therein into said inner housing for fragmentation by said shredder means when said cover means is in the closed condition;

conveyor means, said conveyor means defining a second extension of said inner housing, said conveyor means receiving and transporting said fragments away from said inner housing;

means for maintaining a pressure within said inner housing and said first and second extensions thereof which is less than the ambient atmospheric pressure when the apparatus is in use; and air lock means for discharging said fragments from said conveyor means for subsequent compaction.

2. The apparatus of claim 1 wherein said shredder means comprises at least a primary shredder assembly and a secondary shredder assembly, said shredder assemblies being sequentially positioned, said secondary shredder assembly reducing the average size of the fragments produced by said primary shredder assembly.

3. The apparatus of claim 2 wherein each of said primary and secondary shredder assemblies includes a plurality of counter-rotating cutters and wherein said apparatus further comprises:

a transition chute interposed between said primary and secondary shredder assemblies.

4. The apparatus of claim 3 further comprising:

combustion suppression means located within said inner housing.

5. The apparatus of claim 3 further comprising:

means for interrupting the operation of said apparatus if the pressure within said inner housing exceeds a pre-determined threshold value.

6. The apparatus of claim 3 wherein said pressure maintaining means includes:

vacuum pump means, said vacuum pump means being pneumatically coupled to said inner housing; and filter means disposed between said inner housing and said vacuum pump means for removing air borne wastes from the gas stream exiting said inner housing.

7. The apparatus of claim 3 wherein said shredder means further comprises:

overload sensor means, said overload sensor means automatically causing operation of said shredder assemblies to clear a jammed condition thereof.

8. The apparatus of claim 1 wherein said shredder means comprises a plurality of counter-rotating cutters.

9. The apparatus of claim 1 further comprising:

combustion suppression means located within said inner housing.

10. The apparatus of claim 1 further comprising:

means for interrupting the operation of said apparatus if the pressure within said inner housing exceeds a pre-determined threshold value.

11. The apparatus of claim 1 wherein said pressure maintaining means includes:

vacuum pump means, said vacuum pump means being pneumatically coupled to said inner housing; and filter means disposed between said inner housing and said vacuum pump means for removing air borne wastes from the gas stream exiting said inner housing.

12. The apparatus of claim 1 wherein said shredder means includes:

overload sensor means, said overload sensor means causing said shredder means to operate so as to clear jammed articles impeding the operation of said shredder means.

13. The apparatus of claim 1 further comprising:

an outer housing, said outer housing encompassing said inner housing, said feeder means defined first extension passing through the wall of said outer housing, said conveyor means defined second extension passing through the wall of said outer housing.

14. The apparatus of claim 13 wherein said pressure maintaining means includes:

vacuum pump means, said vacuum pump means being pneumatically coupled to said inner housing; and filter means disposed between said inner housing and said vacuum pump means for removing air borne wastes from the gas stream exiting said inner housing.

15. The apparatus of claim 14 wherein said shredder means comprising at least a primary shredder assembly and a secondary shredder assembly, said shredder assemblies being sequentially positioned, said secondary shredder assembly reducing the average size of the fragments produced by said primary shredder assembly.

16. The apparatus of claim 15 wherein each of said primary and secondary shredder assemblies includes a plurality of counter-rotating cutters and wherein said apparatus further comprises:

a transition chute interposed between said primary and secondary shredder assemblies.

* * * * *